United States Patent [19]

Bugiel

[11] Patent Number: 4,690,062

[45] Date of Patent: Sep. 1, 1987

[54] WARHEAD, ESPECIALLY FOR THE ATTACKING OF RADAR INSTALLATIONS

[75] Inventor: Horst G. Bugiel, Bonn, Fed. Rep. of Germany

[73] Assignee: Diehl GmbH & Co., Nuremberg, Fed. Rep. of Germany

[21] Appl. No.: 877,795

[22] Filed: Jun. 24, 1986

[30] Foreign Application Priority Data

Jul. 13, 1985 [DE] Fed. Rep. of Germany ..... 3525147

[51] Int. Cl.[4] ..... F42B 11/22

[52] U.S. Cl. ..... 102/476; 102/374; 102/491

[58] Field of Search ..... 102/491–497, 102/476, 306–310, 374, 481

[56] References Cited

U.S. PATENT DOCUMENTS

| | | | |
|---|---|---|---|
| 3,188,955 | 6/1965 | Brown | 102/306 |
| 3,357,356 | 12/1967 | Bischoff | 102/378 |
| 3,474,731 | 10/1969 | Thomanek | 102/476 |
| 3,967,553 | 7/1976 | Keraus et al. | 102/476 |
| 4,374,495 | 2/1983 | Thomanek | 102/476 |
| 4,459,915 | 7/1984 | Lynch | 102/493 |
| 4,612,859 | 9/1986 | Furch et al. | 102/476 |

FOREIGN PATENT DOCUMENTS

| | | | |
|---|---|---|---|
| 2307581 | 8/1974 | Fed. Rep. of Germany | 102/476 |
| 2205074 | 3/1977 | Fed. Rep. of Germany | 102/476 |
| 2552871 | 4/1985 | France | 102/476 |

*Primary Examiner*—Harold J. Tudor

*Attorney, Agent, or Firm*—Scully, Scott, Murphy & Presser

[57] ABSTRACT

A warhead for a nose-diving aircraft or missile utilized for the attacking of quasi-stationary targets which possess reducing or weakening armour along their vertical height, especially such as radar installations. The warhead has its explosive received within frusto-conically shaped casing region which is constructed as a fragmentation casing, and a cylindrical casing region located in front of the base or tail end, and which is covered with small, radially oriented projectile-forming inserts.

11 Claims, 2 Drawing Figures

WARHEAD, ESPECIALLY FOR THE ATTACKING OF RADAR INSTALLATIONS

BACKGROUND OF THE INVENTION

1. Field of the Invention

The present invention relates to a warhead for a nose-diving aircraft or missile utilized for the attacking of quasi-stationary targets which possess reducing or weakening armour along their vertical height, especially such as radar installations.

2. Discussion of Prior Art

The need for such a warhead which is optimized for such utilization can be ascertained from the article "Anti-Radar-Lenkwaffe ALARM" in the publication *WEHRTECHNIK,* Volume 5/1985, pages 92 and 93.

SUMMARY OF THE INVENTION

Accordingly, it is an object of the the present invention to provide a warhead which takes into consideration the special conditions of the differing armoring of target configurations which are close to the ground and which are to be attacked through a nose-dive.

The foregoing object is inventively achieved through the utilization of a warhead in which its explosive is received within frusto-conically shaped casing region which is constructed as a fragmentation casing, and a cylindrical casing region located in front of its base or tail end, and which is covered with small, radially oriented projectile-forming inserts.

It is basically known, for example, from the disclosure of German Laid-Open Patent Appln. No. 33 36 853, that for the simultaneous attacking of targets possessing different armor thicknesses or strengths, there can be employed so-called multi-purpose warheads, which are constituted of the combination of a radially-effective fragmentation section with radially-effective projectile-forming inserts rearwardly of an axial hollow charge. However, the inventive utilization of a warhead in a nose-diving aircraft, which is correlated with the special conditions provided by targets in the form of radar installations, will produce results in the target which cannot be expected from the mere presence of such previously known multi-purpose warheads.

It is the performances or energies and the orientations of the individual active components of a warhead for such a nose-diving aircraft which are correlated with the typical distribution of the armored strength and vulnerability of the enemy target in the surroundings of the point of impact of such an aircraft or missile. It has been shown that in the design of the warhead for four different active components it is possible to achieve an optimized result with respect to the effort and effect in the target; namely, the intense damage to or even the total destruction of buildings or armored vehicles together with the electronics and power supply installations located therein, as well as structures which are more lightly armored and which are arranged higher above the ground, and of practically unarmored antenna structures. As a result, there is obtained a somewhat rotationally-symmetrical effect about the vertical at the point of impact of the aircraft, when the main axis of its warhead is somewhat offset at an angle relative to the longitudinal axis of the aircraft, which is constructively or aerodynamically given through the final trajectory during homing onto the target object. An optimum utilization of fragments at a relatively close or narrow angle relative to the horizontal above the ground is achieved by means of an essentially cylindrical warhead, from which there are delivered solid fragments, especially in the shape of explosively-formed projectiles, within a narrow flat spatial region, whereas in contrast therewith, there are delivered lighter fragments, especially ballistically expediently preformed fragments, within a broader angular range at an incident angle relative to the horizontal. For obtaining of the direct hit, provided in the end region of the warhead is a flat hollow charge for the formation of a projectile-like active member possessing a high penetrating force.

For the continued disruption of the operational readiness of antenna constructions which project higher above the impact point on the ground, there are employed neither large nor intermediately sized fragments, but a mixture which is to be designated as "material fog or cloud" through the intermediary of extremely small fragment particles, which are dispersed practically over the entire half sector behind the airborne member or projectile, and which distribute with the pressure wave of the explosion of the warhead; in essence, which act destructively over a large surface against the antenna construction. Such a fragment cloud is produced by the destruction of the operational aggregates, in particular, the propulsion motor, which the flying member causes by means its residual propellant, which is converted in an explosive-like manner such that, as the result of the detonation of the warhead, an oxidation medium is fired into the propellant tank. Hereby, in the interest of obtaining the intended fragment mixture, a preliminary destruction of the applicable aggregate or components can be implemented through the use of cutting charges positioned in proximity thereto, which are detonated concurrently with or immediately prior to the conversion of the residual propellant.

BRIEF DESCRIPTION OF THE DRAWINGS

Additional alternatives and embodiments, as well as further features and advantages of the invention can now be readily ascertained from the following detailed description of an exemplary embodiment of the warhead and its fragmentation effect, taken in conjunction with the accompanying drawings; in which.

DETAILED DESCRIPTION

Figure 1:
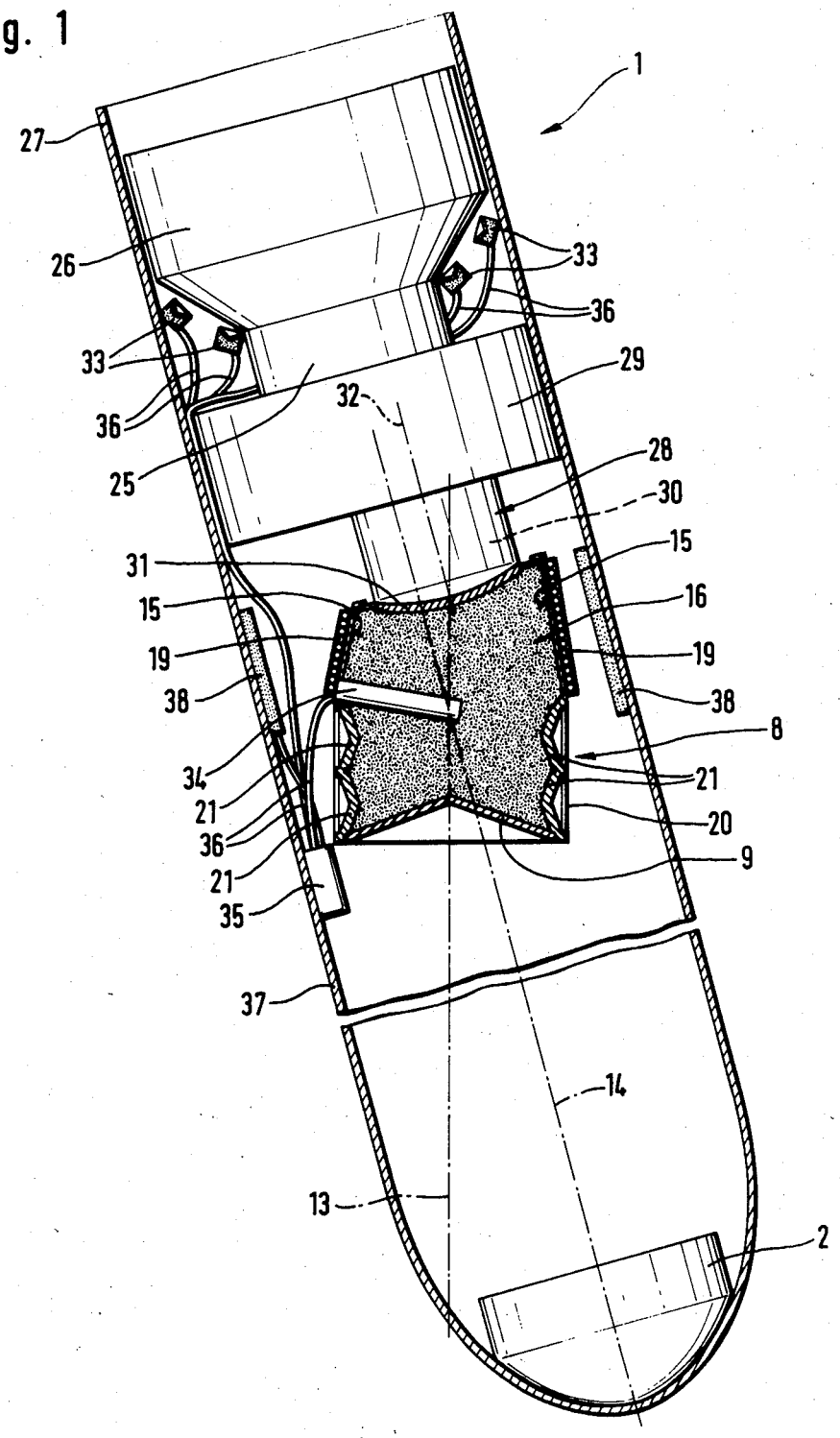
FIG. 1 illustrates a longitudinal sectional view of a preferred embodiment of a warhead with consideration to its cooperation with the propellant tank, which is built into an airborne body.

The airborne body or missile 1 illustrated in the drawing can relate to a projectile which is guided during its final flying phase, or to an unmanned drone which is equipped with a search device, which is designed for the purpose that, by means of a preferably purely passively operating microwave detector 2, it is homed onto the momentary location of a radar installation 3 (refer to FIG. 2), when the latter, if even only temporarily, has activated its transmitter, in effect, radiates electromagnetic energy within a corresponding frequency band. The enemy radar installation 3 which is to be attacked by means of the airborne body 1 can be stationary (land bound) or quasi-stationary (installed on loud vehicles or water vessels). Such a radar installation 3 distinguishes itself through its extremely varying and upwardly reducing armor strength. The strongest armor is possessed by a stationary building (bunker), or for example, a chain-tracked armored carrier vehicle; consequently, it is located in a magnitude of up to about two meters above the ground 4. Extending thereabove is the semi-strong armor of buildings, vehicles or ship super structures, which finally carry the antenna structures 7, which are to be either tiered so as to be lightly armored, or are even grid-like shaped or sheet metal-like.

Based on the grounds for the requirements with regard to the actual implementation of the detector 2 and the guidance arrangement (not shown in the drawing) for the airborne body 1, especially when a radar location 3 detected from a greater distance has transmitted for only a short period, there must also be considered the locating of a strike within a closer vicinity to the radar installation 3. Even at such a strike location or near miss, should there be assured the greatest possible effect in the target, namely, in any case, a destruction of the high frequency installations.

For this purpose, in the airborne body 1 there is installed a so-called multi-purpose warhead 8; which for the case of a direct hit, is equipped with a projectile-forming, essentially shallow-conical or spherically cup-shaped insert 9 for penetrating even the heavy armor of target objects, and for the remainder is equipped with coverings of fragments for achieving different effects in different spatial sectors. In order that these fragmentation effects are distributed as symmetrically as possible about the point of impact 10 (FIG. 2) of the airborne body or missile 1, irrespective as to whether the airborne body 1 which is homed onto the radar installation 3 in steep diving flight, because of aerodynamic reasons does not home onto the point of impact 10 vertically, but at a predetermined striking angle 12 which is offset relative to the vertical 11, then the axis 13 of the warhead 8, and consequently the axis of effect of its projectile-forming insert 9, is displaced somewhat by about this angle 12; in essence, at an acute angle, from the direction of flight or longitudinal axis 14 of the airborne body 1.

Thereby, the axis 13 of the warhead is approximately vertically oriented at the point of impact 10; and the axially symmetrical fragment coverings of the warhead 8 lead to essentially horizontal fragment dispersions, in effect, most extensively avoid any losses in energy due to striking into the ground 4 in close vicinity to the point of impact 10. The distributing height and, accordingly, the radial operative range of the fragments depends upon at which height above ground the warhead 8 is detonated; which can be constructively determined by the length of the airborne body 1 in front of the built-in location of its warhead 8, and as needed, can be increased even further by a mechanical or electronic proximity fuse, in order to ensure that the essentially horizontally extending spatial sector of the effective range of the fragments is possibly just at the level of the semi-armored structures 6 located above the ground in the vicinity of the point of impact 10.

In the interest of obtaining a satisfactory angular width for this effective fragmentation sector, the fragment casing area 15, which laterally encompasses the explosive 16 of the warhead 8 rearwardly of the insert 9 at the end surface, is constructed similar to a truncated cone; in effect, is inclined relative to the axis 13 of the warhead.

As a result, the middle distributing plane 17 of the fragments of this casing area, which when the warhead axis 13 extends vertically through the point of impact 10, does not extend horizontally, but rather shallow-conically; in order possibly to reach (as ascertained from FIG. 2) through a sufficiently intensely increasing effective fragmentation area 18, also further projecting structures 6 at a greater radial distance, and to reduce any energy losses in the form of fragment particles which strike against the ground 4 already after a short flying period. In the interest of obtaining a high kinetic energy and expedient aerodynamic characteristics, the fragment casing or jacket area 15 preferably possesses a covering of preshaped particles, especially in the shape of spheroids or balls 19.

Figure 2:
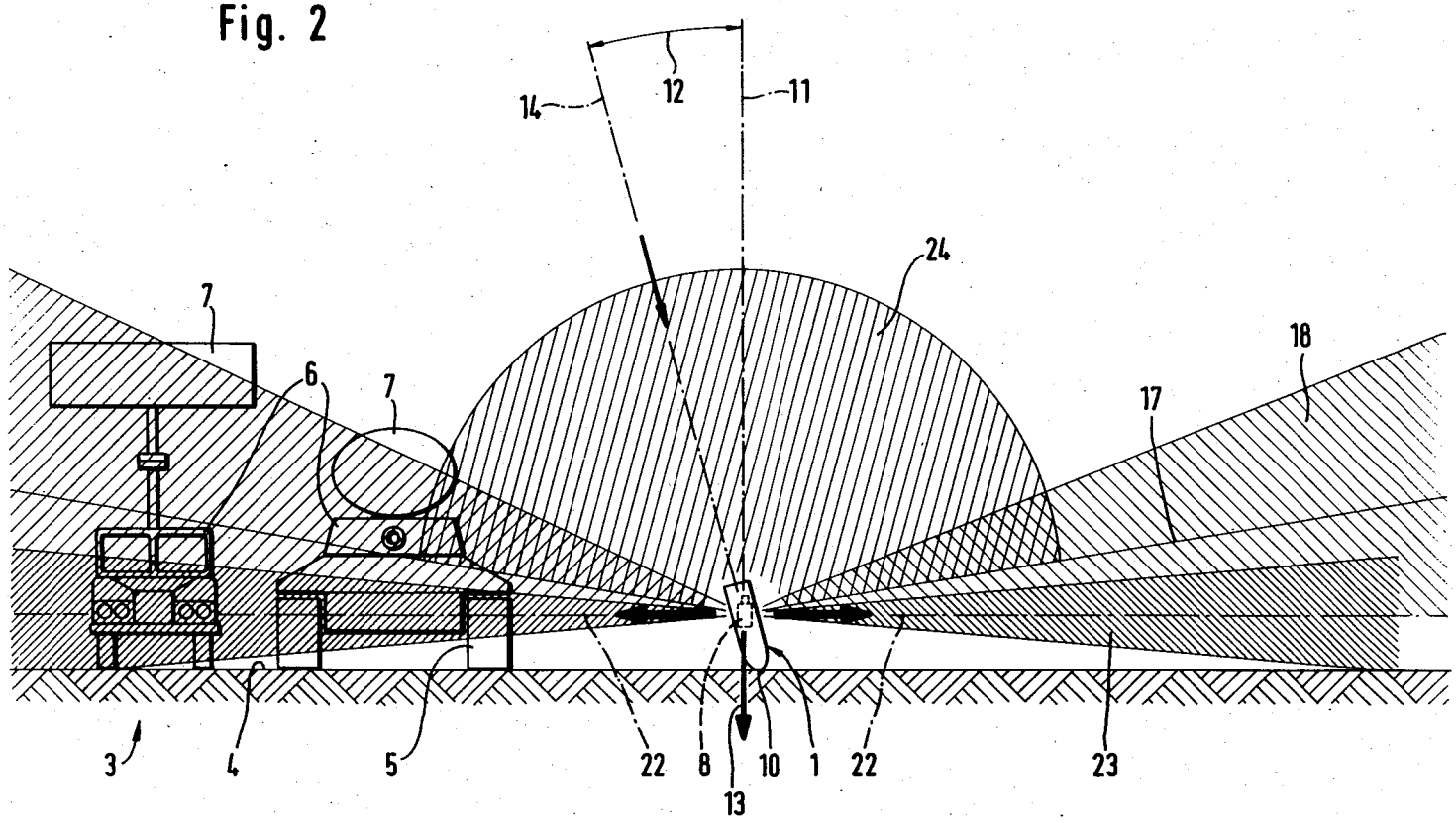
FIG. 2 graphically illustrates the fragmentation effect of the warhead upon impact of the airborne body in the vicinity of a mobile radar installation.

However, this fragmentation effect is not always adequate for the effective attacking of armored targets 5 in the vicinity of the point of impact 10 closely above the ground 4. As a consequence, introduced between the frustoconically shaped fragment casing area 15 and the insert 9 at the end surface, is the explosive 16 encompassed by a hollow cylindrical casing section 20, which is covered by a multiplicity of peripherally mutually offset small projectile-forming inserts 21. The projectiles which are formed upon the detonation of the explosive 16 by the inserts 21, and which are fired at an extremely high kinetic energy, move radially in practically one effective plane 22 relative to the effective axis of the warhead 13, and thereby essentially horizontally above the ground 4 for the attacking of armored targets 5 immediately above the ground 4, in an action sector 23 which is extremely acutely angled, and extends concentrated about the axis of symmetry 13 (as shown in FIG. 2).

In order to cause widespread destruction to the light antenna constructions 7, the masses themselves which are discharged from the fragment casing area 15 are still much too compact and too energy-rich; whereby a mere local piercing of the antenna construction 7 would not produce the desired effect in the target.

As a result, provision is made that, by means of the warhead 8, within a large spatial region 24 behind the airborne body 1 there is dispersed a large mass of essentially small fragments of average kinetic energy, which additionally distributes because of the pressure wave produced during the explosion of the explosive 16; in essence, act widespreadedly over unarmored targets, such as antenna structures 7 (especially at a greater elevation above the ground 4) and there lead to such intense deformations as to eliminate the geometric conditions for a usable antenna characteristic. Serving as the material for the delivery of such a fragment cloud in the spatial region 24, are the operational aggregates or components of the airborne body 1, especially its generator 25, and above all its propulsion motor 26, which are installed rearwardly of the warhead 8 in the airborne body 1. It is particularly expedient when the propulsion motor 26 relates to a material-rich die cast metal component, such as in the case of a multi-cylinder displacement piston-internal combustion engine for the powering of the propeller of a drone, which is located behind the tail end of the airborne body (not shown in the drawing). As an explosive for the disintegration of these components into a large fragment mass, there preferably is employed the residual supply of propellant which is still present at the point of impact 10, in reaction with an oxidizer material.

For this purpose, pursuant to the preferred embodiment illustrated in FIG. 1, arranged at the rear on the warhead 8 is an oxidizer container 28, and between the latter and the airborne body components which are to be disintegrated, its propellant tank 29. Upon the detonation of the warhead explosive 16, the oxidizer material 30 (for example, an oxygen emitting explosive component) in the partially still (for example, with benzine) filled propellant tank 29, is as indicated, fired thereinto so as to there initiate an explosion-like reaction. In order to concentrate the direction of effect of this reaction against the components which are to be disintegrated, especially the propulsion motor 26, arranged between the explosive 16 and the oxidizer container 28; in effect, opposite the base of the frustoconically shaped fragment casing area 15, is a cladding 31 in the form of a spherical cup-shaped flat hollow charge, whose axis of effect 32 extends in parallel with the longitudinal axis 14 of the airborne body, in essence, offset relative to the front sided axis of action 13 of the warhead.

In order to propagate the disintegration of the large components, in particular the propulsion motor 26, provided therein (as in FIG. 1) can be small cutting charges 33 (small hollow charges with acutely-angled linear or conical inserts); which are detonated, for example, concurrently with the detonator 34 for the explosive 16 for the warhead 8, and thereby will initiate, immediately before the reaction produced in the propellant tank 29, the disintegration of the material, so that by means of moderate kinetic energy, referred to as a material fog, and discharged into the rearward hemi-spherically shaped spatial region 24.

The coordination between the actuation of the cutting charges 33 and the warhead detonator 34 is represented in the drawing through a common connection with a central safety and triggering device 35, which can be triggered by the shock produced upon the striking of the airborne body 1 against the ground 4, or through a proximity fuse (not shown). The operative detonator connections 36 which extend from the triggering device 35 are preferably constructed as pyrotechnic ignition cords, so as to securely prevent any premature triggering during direct approach to a radar installation 3 which can be caused by intense electromagnetic disruptive fields.

Similarly, through connection to the central triggering device 35, there is considered in FIG. 1 that it can be expedient to arrange auxiliary charges 38 on the casing 37 of the airborne body 1 in the vicinity the fragment casing area region 15, somewhat in the form of explosive foils; which lead to a rupturing or perforation of the casing 37, such that the fragments, for example, the balls 19, lose the least possible amounts of kinetic energy when they are fired sideways through the casing 37.

What is claimed is:

1. A steeply diving airborne body including a propulsion motor and a warhead for the attacking of quasistationary targets possessing armor reducing in strength along the vertical extension thereof, especially radar installations; the improvement comprising: said warhead including an explosive encompassed by a frusto-conical casing area constituted of a fragmentation casing; an oxidizer container in an effective region of said explosive arranged between a propellant tank and said explosive; and operational components of said propulsion motor being located at an opposite side of said propellant tank relative to said oxidizing container.

2. Airborne body as claimed in claim 1, wherein a spherically cup-shaped cladding covers a rearward surface of said explosive.

3. Airborne body as claimed in claim 2, wherein the axis of the cladding extends generally in parallel with the longitudinal axis of said airborne body.

4. Airborne body as claimed in claim 1, wherein cutting charges are arranged in a region proximate to the propulsion motor.

5. Airborne body as claimed in claim 4, wherein a common triggering device is connected to the cutting charges and to a detonator for the explosive for actuation thereof.

6. Airborne body as claimed in claim 5, wherein operative detonator conductors which are impervious to disruptive electromagnetic fields interconnect said common triggering device with said cutting charges and with said detonator for said explosive.

7. Airborne body as claimed in claim 2, wherein said explosive has the end surface thereof, at the frusto-conical casing area opposite the end covered by said cladding, covered with a projectile-forming insert.

8. Airborne body as claimed in claim 7, wherein a cylindrical casing section extends rearwardly from said projectile-forming insert; and radially-oriented small projectile-forming inserts being covered by said cylindrical casing section.

9. Airborne body as claimed in claim 8, wherein the frusto-conical casing area extends rearwardly from said cylindrical casing section and is covered with aerodynamically-shaped fragments in the form of spheres.

10. Airborne body as claimed in claim 8, wherein said cylindrical casing section and frusto-conical casing area are arranged at an inclination relative to the longitudinal axis of said airborne body which substantially conforms to a normal impact angle of said airborne body relative to a vertical.

11. Airborne body as claimed in claim 9, wherein the casing of the airborne body is covered with perforation-producing auxiliary charges in at least the region of the casing area which is covered with said spherical fragments.

* * * * *